US005829323A

United States Patent [19]

Liston

[11] Patent Number: 5,829,323

[45] Date of Patent: Nov. 3, 1998

[54] NAIL SPIKE GUIDE AND SUPPORT HAND TOOL

[76] Inventor: Douglas A. Liston, 989 Rosemary, Helena, Mont. 59601

[21] Appl. No.: 703,815

[22] Filed: Aug. 27, 1996

[51] Int. Cl.[6] ..... B25C 3/00

[52] U.S. Cl. ..... 81/44; 81/420; 81/426.5

[58] Field of Search ..... 81/44, 420, 424.5, 81/426.5

[56] References Cited

U.S. PATENT DOCUMENTS

| | | | |
|---|---|---|---|
| 347,675 | 8/1886 | Whipple . | |
| 508,591 | 11/1993 | Alexander . | |
| 827,392 | 7/1906 | Prangemeier . | |
| 869,527 | 10/1907 | Shears | 81/420 |
| 1,114,649 | 10/1914 | Reed | 81/426.5 |
| 1,715,819 | 6/1929 | Dealy . | |
| 2,130,748 | 9/1938 | Suter | 81/420 |
| 2,507,784 | 5/1950 | Hamel | 81/420 |
| 3,329,044 | 7/1967 | Singer | 81/424.5 |
| 4,017,958 | 4/1977 | Diggs | 29/268 |
| 4,079,765 | 3/1978 | Hatayan | 145/46 |
| 4,201,258 | 5/1980 | Elmore | 145/46 |
| 4,386,461 | 6/1983 | Plummer | 81/420 |
| 4,872,709 | 10/1989 | Stack | 285/39 |
| 5,014,578 | 5/1991 | Flentge | 81/420 |
| 5,293,792 | 3/1994 | Chiang | 81/44 |
| 5,375,488 | 12/1994 | Baitner | 81/44 |

*Primary Examiner*—James G. Smith
*Assistant Examiner*—Lee Wilson
*Attorney, Agent, or Firm*—Jacobson, Price, Holman & Stern, PLLC

[57] ABSTRACT

A plier-type tool grips the spacing tube or ferrule which surrounds lengthy spikes used to secure a rain gutter to a building. The tool has legs that are pivotally connected and are used to open and close opposing arms that form a jaw. The inside surface of each arm of the jaw is fitted with half a cylindrical tube. The tube halves come together to form a single elongated tube at the front end of the nail spike grip. The tube is transversely positioned on the tool so as to generally form a T-shape with the legs of the nail spike grip. The tube fits within the channel of a rain gutter and is used to guide and support a spike as it is positioned within a spacing tube during installation. While supported by the tool the spike is driven through the inner wall of the gutter and into the trim of the building in order to secure the rain gutter thereto.

17 Claims, 1 Drawing Sheet

NAIL SPIKE GUIDE AND SUPPORT HAND TOOL

BACKGROUND OF THE INVENTION

1. Field of the Invention

The present invention relates to a device for holding and guiding a nail that is being driven into a substrate. More particularly, the present invention relates to a tool for holding and guiding the nail so that it does not bend when driven into a substrate, and especially lengthy aluminum spikes used to secure aluminum rain gutters to the trim of a house.

2. Description of the Related Art

Rain gutters are normally secured to the trim of a building by hammering spikes through the front and back walls along the length of the rain gutter, and into the building trim. An elongated spacing tube, or ferrule, is normally positioned between the front and back walls to receive the spike. The ferrule provides equal spacing for the width of the gutter along its length, and prevents the rain gutter from collapsing during installation.

Due to the width and weight of the rain gutter, lengthy spikes are required in order to securely fasten the rain gutter to the building. The extensive length of the spike makes the spike especially susceptible to bending as it is driven into the building. In addition, rain gutters and the spikes, are commonly made of aluminum metal, which makes the spike further prone to bending when the nail strikes a knot in the wood or the hammer does not strike the nail perfectly. Likewise, the ferrules are commonly made of aluminum metal, and are not of sufficient strength to prevent the spike from bending.

Bent spikes are also particularly troublesome when installing rain gutters since the rain gutter and ferrules may be damaged as the spike is bent. In addition, care must be exercised to remove the spike without causing further damage to the rain gutter, the ferrules, or to the trim. Bent spikes result in a substantial loss of time on the installation job since the bent spike must be removed or sawed off if necessary, and another nail hammered in. Further, there is an added danger since workers are often in precarious positions in order to install the rain gutters, such as on a roof or ladder.

Various tools have been developed that hold and guide a nail as it is being driven into a substrate, such as shown in U.S. Pat. Nos. 5,293,792, 4,201,258, 4,079,765, 1,715,819. These nail guides are fashioned as plier-type tools having an elongated and tapered jaw with opposing arms. Grooves of various sizes are formed in the arms of the jaw in order to hold and guide nails of assorted dimensions.

The conventional nail guides, however, have several drawbacks. The grooves are only as long as the width of the tool itself, so that nails of considerable length are unstable and difficult to guide. In addition, where a tool is fashioned with multiple grooves, it is often difficult to utilize the innermost grooves for situations in which there is insufficient space to position the end of the jaw. For these reasons, the conventional nail guides are not particularly suited for hammering elongated nails, especially aluminum nails used for installing a rain gutter.

SUMMARY OF THE INVENTION

The nail spike grip of the present invention is a plier-type tool having levers pivotally connected about a connect point defining a front end and a rear end. Legs forming handles are located at the rear end of the nail spike grip and a jaw with opposing arms is positioned at the front end.

Each arm of the jaw is transversely fitted with an elongated member that comprises a half a tube. The tube halves come together to form a single elongated passage in the jaw at the front end of the nail spike grip. The tube is transversely positioned so as to generally form a T-shape with the longitudinal body of the nail spike grip. The jaw is operatively opened and closed to receive the ferrule, with the enclosed spike. Thus, the inside diameter of the tube is slightly larger than the outer diameter of the ferrule so that the tube provides support to a significant portion of the lengthy spike to be hammered and is particularly suited to support aluminum spikes used to secure a rain gutter to a building.

Accordingly, it is a primary object of the present invention to provide a nail spike grip that is suited for holding and guiding an aluminum nail that is used to affix aluminum rain gutter to the trim of buildings, such as houses and the like.

It is a further object of the invention to provide a nail spike grip that can securely hold and guide lengthy nails.

It is yet another an object of the invention to provide a nail spike grip that is simplistic in design and construction and which parts can be easily manufactured and assembled.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
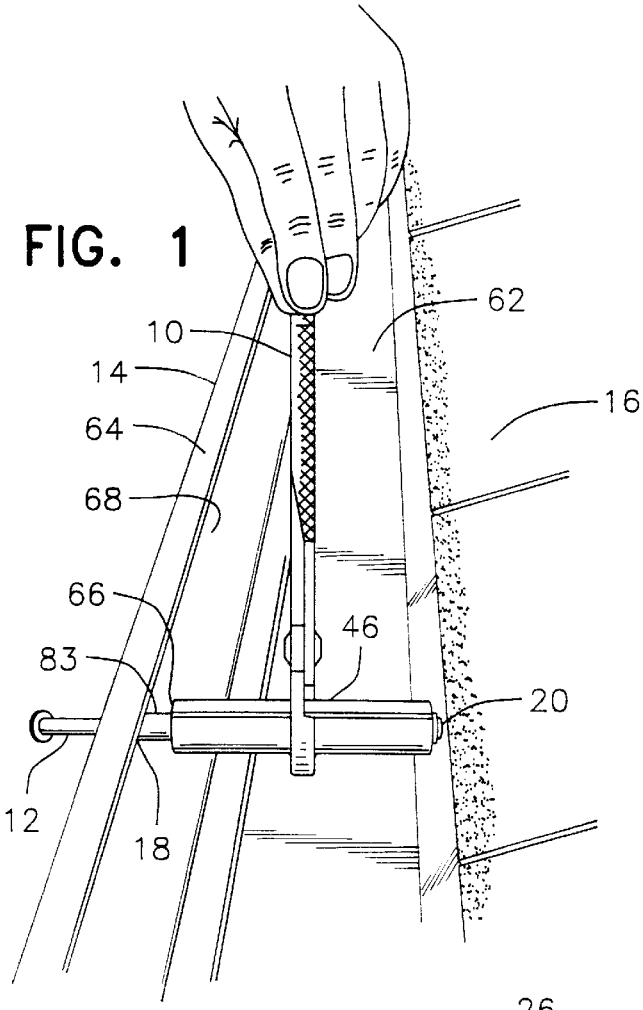
FIG. 1 shows the preferred nail grip of the present invention used to hold and guide a spike as it is driven into the trim of a building to secure a rain gutter thereto.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to the drawings, FIG. 1 generally shows the nail spike grip 10 of the present invention. The nail spike grip 10 is being used to hold and guide a spike 12, typically made of aluminum, as it is driven through a rain gutter 14, normally via ferrule 83, both of which are also typically made of aluminum, and into the trim of a building 16. The nail spike grip 10 may be positioned about spike 12 in a variety of ways that are in accordance with the present invention.

Preferably, spike 12 is first hammered through the top edge of the outer side wall 68 of rain gutter 14 to form outer hole 18. As the piercing end of spike 12 extends through the outer hole 18, a spacing tube or ferrule 83 is positioned over the piercing end. The spike 12 is then pushed through hole 18 and ferrule 83 until the piercing end contacts the inner side wall 81 of rain gutter 14. The spike 12 will thereby extend substantially across the channel 62 inside of ferrule 83. The nail spike grip 10 is then opened and positioned over the ferrule 83, containing the shank of spike 12, as it extends substantially across the width of channel 62. The nail spike grip 10 is then closed to surround ferrule 83. Preferably, there is a small gap between the nail spike grip 10 and the ferrule 83 so as to permit the ferrule 83 to move slightly. However, the nail spike grip 10 may be further designed to securely grasp ferrule 83.

Once the ferrule 83 is positioned within the nail spike grip 10, the spike 12 is driven through inner side wall 81, forming hole 20 and then into the trim of building 16. The nail spike grip 10 thereby supports the spike 12 and ferrule 83, from bending, while permitting spike 12 to be freely driven through wall 81 and into the trim of building 16. Meanwhile, the ferrule 83 prevents the rain gutter side walls 68, 81 from collapsing as the spike is being driven into the trim of building 16. The ferrule 83 further provides equal spacing along the length of the rain gutter 14.

The spike 12 and ferrule 83 are preferably assembled while the rain gutter 14 is on the ground. Only then is the rain gutter elevated to the trim of building 16. Thus, only the single step of driving the spike 12 through the wall 81 and into the trim is all that remains once the gutter 14 is raised. However, this is also the point at which the spike 12 is most prone to bending. Thus, the nail spike grip 10 can be quickly positioned over the ferrule 83 and spike 12 prior to the final step of driving the spike 12 through the inner gutter wall into the trim of building.

In an alternative embodiment, the nail spike grip 10 may first be positioned about ferrule 83. The spike 12 is then passed through the outer side wall 68 of the rain gutter 14, forming an outer hole 18. As the spike 12 passes through the outer side wall 68, one end 66 of nail spike grip 10, along with the enclosed ferrule 83, is aligned with the outer hole 18 along side wall 68. The spike 12 is passed through the combined ferrule 83 and nail spike grip 10, which is then used to guide spike 12 to the inner side wall 81 of the rain gutter. The spike 12 may then be driven into the substrate 16.

Figure 4:
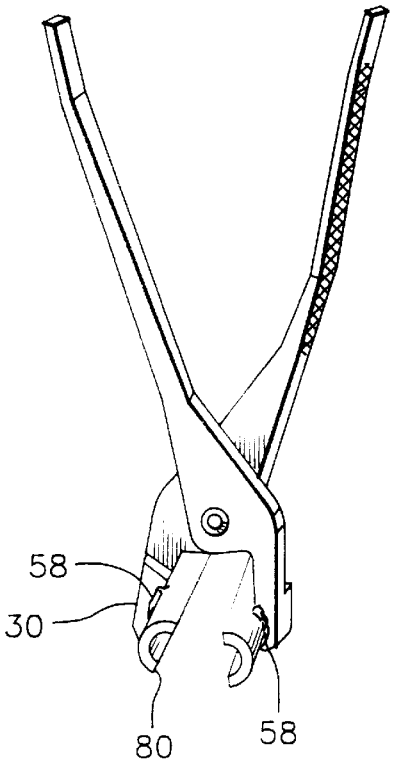
FIG. 4 is a perspective view of the nail spike grip shown in FIG. 1, with the jaw in an open position.
Figure 2:
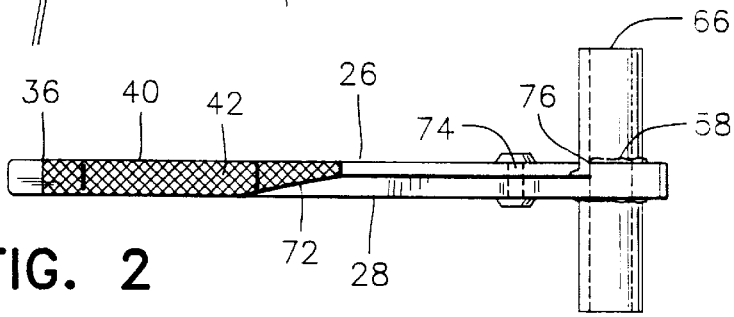
FIG. 2 is a top plan view of the nail spike grip shown in FIG. 1.
Figure 3:
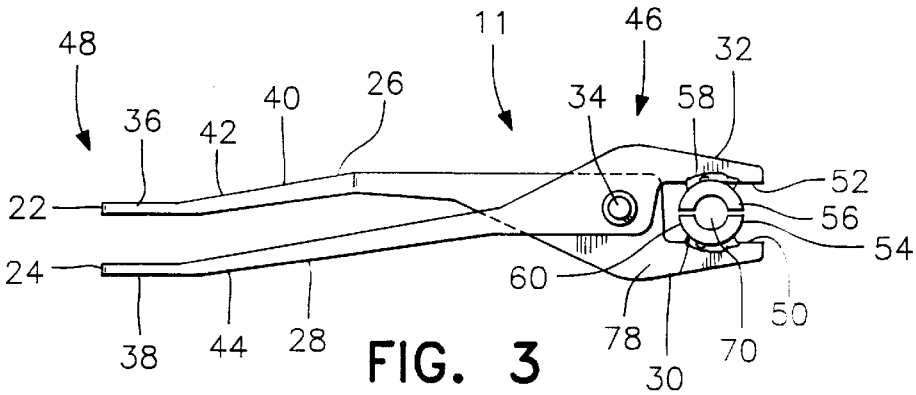
FIG. 3 is a side view of the nail spike grip shown in FIG. 1.

Referring to FIGS. 2–4, the preferred embodiment of nail spike grip 10 will now be discussed in further detail. The nail spike grip 10 is generally configured as a pair of pliers. The body 11 of nail spike grip 10 is comprised of a pair of levers 22, 24 having legs 26, 28 that are connected to a respective arm 30, 32 about a common pivot 34. In the preferred embodiment, pivot 34 is a ¼ inch rivet or a ¼ inch bolt with a lock nut, that extends through respective holes 74 in levers 22, 24. Pivot 34 defines a front end 46 having a jaw 78 with arms 30 and 32, and a rear end 48 having legs 26 and 28.

The legs 26, 28 are designed to be ergonomic with the shape of a user's hand when the nail spike grip 10 is grasped. Preferably, the bottom or lower leg 28 is generally straight with an end 38 that is bent slightly upward. In contrast, upper leg 26 preferably has a middle section 40 that is bent downward toward lower leg 28 so that legs 26, 28 are closer together. The end 36, 38 of each leg 26, 28 is also bent slightly upward in order to be parallel to each other. Accordingly, legs 26, 28 will not contact each other when the nail spike grip 10 is in a closed position but will provide the user with optimum holding control when the jaw 78 is closed around the spike 12.

A central portion of each leg 26, 28 preferably has a roughened texture on their outer surfaces so as to form handles 42 and 44, respectively. For the upper leg 26, handle 42 includes middle section 40, as well as a portion of end 36 and a portion of the leg 26 that adjoins middle section 40, as best shown in FIGS. 2 and 4. Likewise, handle 44 of the lower leg 28 consists of a portion of end 38, as well as part of lower leg 28.

The handles 42 and 44 are preferably tapered as at 72 toward pivot 34 so that the legs 26, 28 may be vertically aligned, while levers 22, 24 are transversely secured at pivot 30. In addition, the taper 72 allows for a wide handle 42 to be provided. The roughened surfaces comprising handles 42, 44 terminates at the inside end of the tapered portion 72.

In the preferred embodiment, levers 22, 24 are about 9¾ inches in length, with each leg 26, 28 being approximately 7⅜ inches long, including ends 36, 38 which are about 1¼ inches in length. In addition, the legs 26, 28 are tapered at 72 from about 3¼ inches from the back end of levers 22, 24 to the end of the handle section 42, 44 which is approximately 5 inches from the back end of levers 22, 24. In further accord with the preferred embodiment of the present invention, the body 11 of grip 10 comprising the levers 22, 24 and pivot 34 is a channel lock plier.

Each arm 30, 32 has a flat inside surface 50, 52, respectively. The arms 30, 32 are narrowed at lip 76 so that levers 22, 24 align vertically, while still being transversely connected at pivot 34.

Elongated members 54, 56 are attached transversely to each arm 30, 32, respectively, preferably by welds 58 or the like. Preferably, members 54 and 56 are cylindrical in cross-section and welded to the wide inside surfaces 50 and 52 within lip 76. The welds 58 are made along the top portion of the cylindrical members 54, 56 that comes into contact with the inside surface 50, 52 of arms 30, 32. The inside surfaces 50 and 52 are preferably smooth so that a greater surface area is available for welding the cylindrical members 54, 56 thereto.

The cylindrical members 54, 56 extend outwardly from each side of arms 30, 32 in the transverse direction so that the body 11 of nail spike grip 10 generally forms a T-shape, as best shown in FIG. 2. In the preferred embodiment, cylindrical members 54, 56 are 4 inches in length, whereas the arms 30, 32 are only about ½ inch in width. Accordingly, cylindrical members 54, 56 extend approximately 1¾ inches outward on either side of arms 30, 32.

Cylindrical members 54, 56 preferably comprise a cylindrical tube that has been cut diametrically in half along the longitudinal axis so that the cylindrical members 54, 56 have a cross-section in the shape of a half circle. Accordingly, when nail spike grip 10 is in a closed position, the cylindrical members 54, 56 come together to form a complete cylindrical or lateral tube 60, as best shown in FIG. 3.

The facing surfaces 80 of cylindrical members 54 and 56 are preferably flat. However, surfaces 80 may have any interlocking design, such as a saw-toothed configuration extending either laterally or longitudinally on surface 80. Preferably, in the closed position, cylindrical members 54, 56 contact each other. However, a stop may be provided in accordance with conventional methods, so that the facing surfaces 80 do not actually touch when cylindrical members 54, 56 are in the closed position.

The lateral tube 60 has a through-hole or passage 70 that defines the inside diameter of the tube 60. The passage 70 is designed to be slightly larger than the outside diameter of a standard size ferrule 83 which is used to receive spike 12 that secures the rain gutter 14 to a building 16. The inside diameter of tube 60 fits closely about ferrule 83 in order to provide support to both the ferrule 83 and spike 12 as the spike 12 is driven through the inner gutter wall and into a substrate, such as building 16. Accordingly, the inside surface of tube 60 prevents ferrule 83 and spike 12 from bending as the spike 12 is driven through inner side wall 81 and into substrate 16. The spike 12 moves freely within ferrule 83 so as to be easily driven into substrate 16. In addition, the nail spike grip 10 is designed so that ferrule 83 moves freely within tube 60 so as not to interfere with spike 12 being driven into substrate 16.

Lateral tube 60 provides added holding width to nail spike grip 10 so that the nail spike grip 10 may better support and guide lengthy spikes 12. Whereas conventional nail guides enclose a limited portion of a nail, the lateral tube 60 permits nail spike grip 10 to support a substantial length of spike 12. Tube 60 particularly supports the portion of spike 12 that extends across channel 62 of rain gutter 14, where the spike is most vulnerable to bending. Lateral tube 60 also functions to guide and retain spike 12, so that spike 12 may, for instance, be steadily positioned in the inner hole 20 of rain gutter 14 while it is being further hammered.

The cylindrical members 54, 56 are preferably designed to be slightly shorter than the channel 62 of the rain gutter 14. As such, the nail spike grip 10 fits easily into the channel 62 of rain gutter 14 in order to grasp spike 12 as it passes through outer hole 18 and extends across rain gutter 14. The tube 60 is made sufficiently long, however, so as to encompass and provide support to a significant portion of the shank of spike 12 extending across channel 62.

FIG. 1 shows tube 60 as being significantly shorter than the width of the rain gutter 14 to account for the inward lip 64 at the top of the outside portion of the rain gutter. However, the tube 60 may extend the full length of the rain gutter channel 62. Accordingly, the flat end 66 of tube 60 may support the outside wall 68 of the rain gutter 14 to prevent the wall 68 from collapsing or otherwise becoming damaged if spike 12 is driven too far into substrate 16. In this manner, the nail spike grip 10 operates as a spacer so as to eliminate reliance totally on ferrule 83 to prevent driving spike 12 too far into the substrate. Thus, the nail spike grip 10 may be used with or without a spacing tube 83.

In the preferred embodiment, cylindrical members 54, 56 are fashioned from a ¾ inch double-extra strong pipe that has been cut longitudinally in half. Lateral tube 60 preferably has an inside diameter of about seven-sixteenths of an inch and an outside diameter of about ¾ of an inch. The inside diameter of the tube 60 is ⅛ to 1/16 inch larger than the outer diameter of the ferrule 83. The tube 60 may be positioned at any point along inside surfaces 50 and 52. Preferably, however, the tube 60 is set back from the distal end of arms 30, 32 by about ⅜ of an inch so as to be centered on inside surfaces 50 and 52.

The foregoing descriptions and drawings should be considered as illustrative only of the principles of the invention. Numerous applications of the present invention will readily occur to those skilled in the art. For example, the cylindrical members 54, 56 may be constructed to be integral with arms 30, 32, as opposed to being welded to the inside surfaces 50, 52. In addition, the cylindrical members 54, 56 may be configured in any convenient shape so long as the inner surface is generally configured to receive and support a cylindrical spike 12. For instance, members 54, 56 may comprise a rectangular member having a generally rounded groove etched from the surface. In addition, the nail spike grip 10 may be used in any situation requiring a lengthy spike 12 to be driven into a substrate, such as to construct fences. Therefore, it is not desired to limit the invention to the specific examples disclosed or the exact construction and operation shown and described. Rather, all suitable modifications and equivalents may be resorted to, falling within the scope of the invention.

I claim:

1. A device for supporting and guiding a spike having an outer diameter to be driven into a substrate which comprises two elongated members pivotally connected to each other about a connect point defining a front end and a rear end, said elongated members having opposing arms with inside surfaces at the front end and opposing legs at the rear end for opening and closing the opposing arms, and an elongated support member having a generally half-circle cross-section transversely fastened to the inside surface of each opposing arm which, when said opposing arms are closed, form a closed elongated tube having a passage with an inner diameter substantially larger than the outer diameter of the spike for slidably receiving and supporting the spike to be driven.

2. The device of claim 1, wherein the elongated support members are semi cylindrical in shape and receive the spike longitudinally to enclose the spike in the passage of the tube when the opposing arms are closed.

3. The device of claim 1, wherein the elongated support members are semi cylindrical in shape and can receive a ferrule longitudinally when the opposing arms are opened and the ferrule is enclosed in the passage of the tube when the arms are subsequently closed, wherein the ferrule further is capable of receiving the spike.

4. The device of claim 1, wherein the connect point comprises a rivet that pivotally connects the elongated members.

5. The device of claim 1, wherein the device is designed to support a spike that is used to secure a rain gutter to a building.

6. The device of claim 1, wherein the elongated support members have a length substantially the same as a width of a channel of a rain gutter.

7. The device of claim 1, wherein the opposing legs further comprise a handle.

8. A device for supporting and guiding a spike having an outer diameter to be driven into a substrate, said device comprising:

two elongated members pivotally connected to each other defining a jaw that opens and closes, the jaw having opposing arms with inside surfaces; and, elongated support members, each having a smooth inner surface, one of said elongated support members transversely fastened to the inside surface of each of the opposing arms such that a closed tubular passage is formed by the inner surfaces when the jaw is closed, the passage having an inner diameter substantially larger than an outer diameter of the spike wherein the passage slidably receives the spike.

9. The device of claim 8, wherein the opposing support members receive the spike to enclose the spike in the passage when the opposing arms are closed.

10. The device of claim 8, wherein the support members receive a ferrule when the jaw is opened and the ferrule is enclosed in the passage when the opposing arms are subsequently closed, wherein the ferrule is further capable of receiving the spike.

11. The device of claim 8, wherein the device is designed to support a spike that is used to secure a rain gutter to a building.

12. The device of claim 8, wherein the elongated support members have a length that is substantially the same as a width of a channel of a rain gutter.

13. A device for supporting a shank of an aluminum spike while hammering the spike during installation of an aluminum rain gutter having a channel shape, which comprises a plier-type tool with a pair of levers pivoted together to form a pair of handles which operate a pair of arms forming a jaw and a pair of elongated support members laterally attached across each of said arms in a facing relationship such that when said jaw is closed said elongated members form a lateral tubular opening, said opening having an inner diameter substantially larger than an outer diameter of the shank to slidably receive and support said aluminum spike therein over a substantial distance of said gutter channel shape and said elongated members sized to readily fit said gutter channel shape.

14. The device of claim 13, said lateral tubular opening further being sized to receive a ferrule which receives said aluminum spike.

15. The device of claim 13, wherein the elongated support members receive the aluminum spike to enclose the spike in the tubular opening when the jaw is closed.

16. The device of claim 13, wherein the elongated support members receive a ferrule when the jaw is opened and the ferrule is enclosed in the tubular opening when the arms are closed, wherein the ferrule is further capable of receiving the spike.

17. The device of claim 13, wherein the elongated support members have a length that is substantially the same as a width of a channel of a rain gutter.

* * * * *